United States Patent [19]

Abramson

[11] Patent Number: 4,884,351

[45] Date of Patent: Dec. 5, 1989

[54] REFLECTIVE SIGN

[76] Inventor: Marc D. Abramson, 513 Cardinal Dr., Dresher, Pa. 19025

[21] Appl. No.: 200,680

[22] Filed: May 31, 1988

[51] Int. Cl.[4] ..... G09F 15/00

[52] U.S. Cl. ..... 40/606; 40/611; 40/617; 40/618

[58] Field of Search ..... 40/617, 582, 576, 611, 40/649, 606, 653, 609, 618, 620, 596

[56] References Cited

U.S. PATENT DOCUMENTS

| | | | |
|---|---|---|---|
| 2,113,285 | 4/1938 | Wamser | 40/618 |
| 2,855,711 | 10/1958 | Bloom | 40/653 |
| 3,154,870 | 11/1964 | Hopp et al. | 40/617 |
| 4,048,738 | 9/1977 | McHenry | 40/649 |
| 4,144,664 | 3/1979 | DeKorte | 40/609 |
| 4,698,928 | 10/1987 | Soporowski | 40/606 |

FOREIGN PATENT DOCUMENTS

| | | | |
|---|---|---|---|
| 8704555 | 7/1987 | World Int. Prop. O. | 40/606 |

*Primary Examiner*—Gene Mancene
*Assistant Examiner*—Cary E. Stone
*Attorney, Agent, or Firm*—Molasky & Associates

[57] ABSTRACT

A sign for displaying reflective numerals which are slidably engaged in slots provided by a backing plate. The sign is adapted for display in any one of three modes, namely, a bottom portion of the backing plate is coupled with a base stand for upright positioning; or alternatively, the top portion of the plate is coupled to a hook assembly to allow for a hanging arrangement; or lastly, the backing plate may be simply attached to a flat surface.

7 Claims, 2 Drawing Sheets

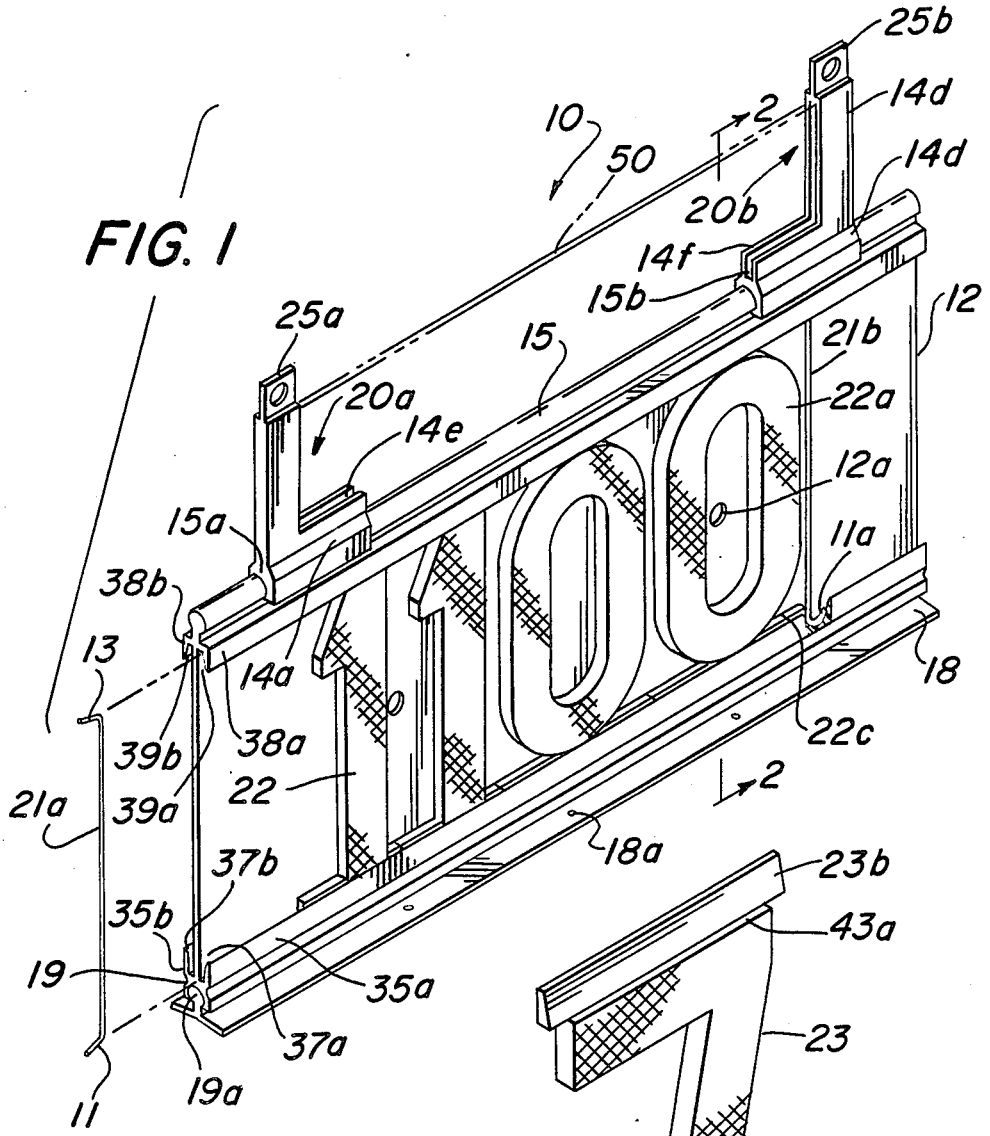
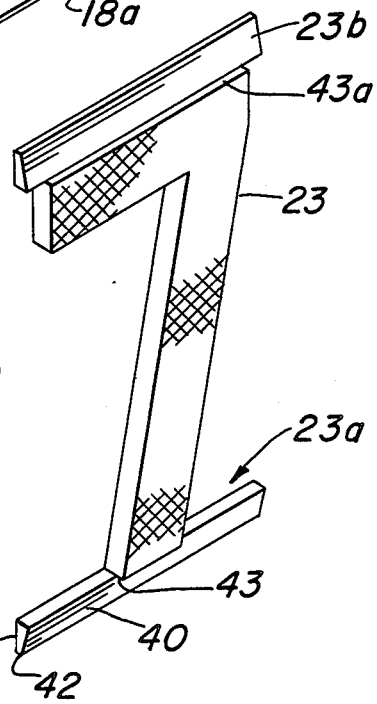
FIG. 4

FIG. 2
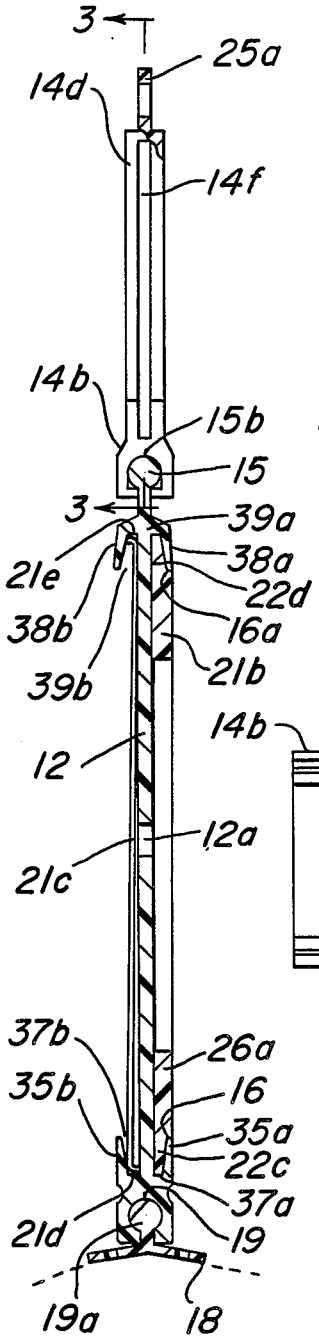
FIG. 3
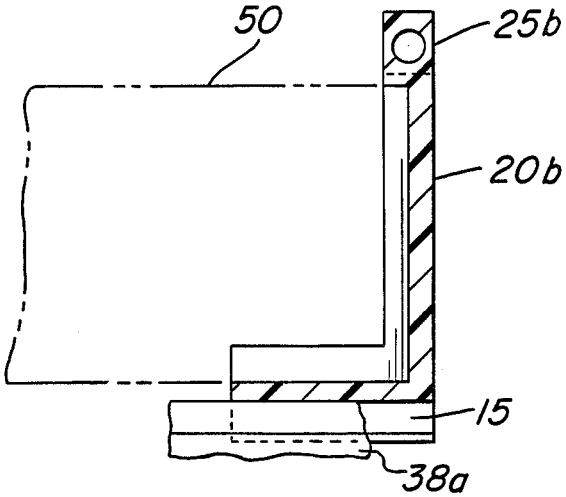
FIG. 5
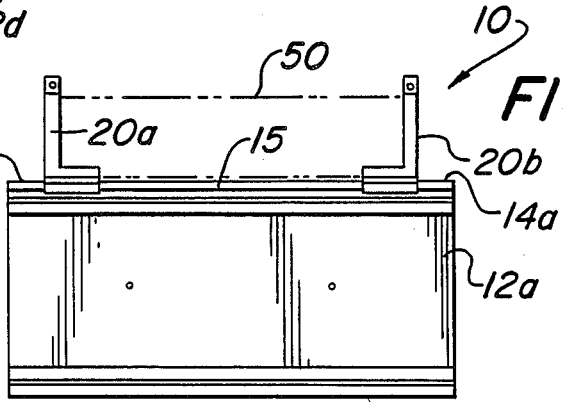
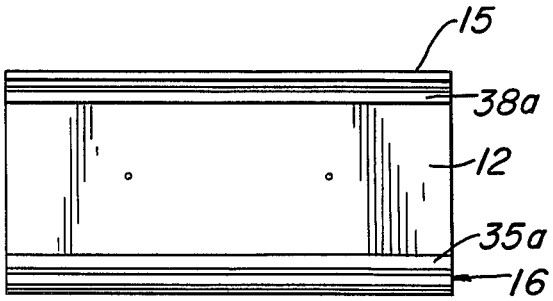
FIG. 6

REFLECTIVE SIGN

BACKGROUND OF THE INVENTION

1. Field of the Invention

This invention relates to sign displays comprised of reflective alpha-numeric characters (letters of the alphabet and numerals) that may be used in various configurations for address and/or resident identification purposes.

2. Description of the Prior Art

There is a need for sign displays equipped with easily replaceable alpha-numeric indicia and a backing plate because they provide a convenient, economical and highly recognizable identification means both at night and during daylight hours. The need for easily identifiable indicia can be important when there is a need to locate an address quickly as, for example, in emergency situations when police or paramedics are in pursuit or on call.

It has been further observed in the practice of the prior art for reflective sign displays, which utilize movable alpha-numeric indicia combinations, that the manner of positioning the reflective numerals of alpha characters with respect to the backing plate is oftentimes cumbersome and lacking in ease of operation. Such a representative prior art display is exemplified in U.S. Pat. No. 2,062,094 wherein the numeric indicia are formed by a plurality of individual units which must be located upon a panel or backing plate by engaging a bayonet slot with certain rod members. This arrangement is cumbersome and lacks a certain ease of operation which is unsuitable in today's competitive economy.

The present invention is designed to provide a facile arrangement for slidably engaging the various reflective indicia upon a backing plate as well as providing an arrangement for displaying the indicia in either a hanging or standing mode.

SUMMARY OF THE INVENTION

The sign display disclosed utilizes reflective indicia in the form of numerals or alpha characters which respectively incorporate horizontal strips positioned across their top and bottom portions. A backing plate provided with the display includes upper and lower slots for slidably receiving the various numerals or characters. Retention means are also provided with the backing plate for locating at either end of a combination of indicia, such as a residential address, for maintaining the numerals in a tight and juxtaposed configuration. The top and bottom linear dimensions of the backplate are respectively arranged into a male and female cross section for respectively joining with a female assembly in order to hang the sign in one mode of display, or in the alternative, for joining with a male stanchion in order to maintain the sign in a standing display. The backing plate also includes holes for allowing a simple attachment to a certain structure.

It is therefore an object of the invention to provide a new and improved outdoor sign display that is relatively simple to fabricate and which results in an economical assembly.

It is another object of the invention to provide a sign display using reflective alpha-numeric india for home or commercial addresses and/or name identification that can be readily sighted at dusk or evening hours, especially by emergency vehicles such as police and ambulance carriers.

It is still another object of the invention to provide a sign display using reflective characters that are also easily discernable during daylight hours.

BRIEF DESCRIPTION OF THE DRAWINGS

FIG. 1 is an isometric view of the reflective sign display of the invention.

FIG. 2 is a sectional view of FIG. 1 taken along the line 2—2.

FIG. 3 is a sectional view of FIG. 2 taken along the line 3—3.

FIG. 4 is an isometric view of a numeral which is designed for use in the embodiment of FIG. 1.

FIG. 5 is a frontal view of the backplate of the invention for use in a hanging mode of operation.

FIG. 6 is another frontal view of the backplate of the invention for use in an upright standing mode of operation.

DESCRIPTION OF THE PREFERRED EMBODIMENT

Referring now to the sign display 10 of FIG. 1 there is shown the novel arrangement for displaying and retaining alpha and/or numeric characters as, for example, the numeral 22 of the combination "1100" for use to identify residential or commercial establishments or similar locations.

The characters are made of reflective plastic such as, for example, a synthetic organic resin which is highly reflective when impinged upon by light from car headlights, and are also easily seen during daylight hours. The sign display 10 utilizes a black, rectangular backplate 12 as further seen in FIG. 6 wherein the top and bottom longest linear dimensions provide respective male and female members 15, 19, which may be clearly seen in cross section in FIG. 2. The male and female members 15, 19 are integrally formed with the backplate 12 and their purpose with respect to display 10 will be discussed in greater detail hereinbelow. Further, integrally formed with the male and female members 15, 19 are upwardly and downwardly respective facing extensions **35*a*, 35*b* and 38*a*, 38*b* as seen in FIGS. 1 and 2. The extensions 35*a*, 35*b* and 38*a*, 38*b* together with the backplate 12 form respective slots 37*a*, 37*b* and 39*a*, 39*b* which are utilized to receive and retain the numeric combination "1100" as shown in FIG. 1. The numerals comprising the combination "1100" which may represent a street address are positioned upon the backplate 12 by slidably positioning the "1" character 22, for example, within the lower slot 37*a* and upper slot 39*a*. The individual numerics of the combination "1100" may be inserted into the slots 37*a*, 39*a* from either the left or right side of the backplate 12 as viewed in FIG. 1 so that they are juxtaposed to one another. It should also be understood that the respective lower and upper slots 37*b*, 39*b* on the reverse side of the backplate 12 are similarly adapted to retain the numeric combination "1100" so that the address identification may be seen by an observer who is approaching from another direction. As an example, if the sign display 10** were being utilized upon a curbside mailbox, the address would be observable in either direction of travel on the street or roadway.

The sectional view of FIG. 2 taken through the last "0" numeral **22*a* of the combination "1100" of FIG. 1 illustrates how it is formed with a bottom strip 22*c* to slidably engage the slot 37***a*; however, an upper strip 22*d* which is obscured in FIG. 1 is clearly seen in FIG. 2 to engage the slot 39*a*. The strips 22*c*, 22*d* also include lips 16, 16*a* for riding and resting upon the tops of respective extensions 35*a*, 38*a*. The lower and upper strip formations formed upon every character may be viewed in greater detail by referring to FIG. 4 where an exemplary "7" numeral 23 is illustrated. The "7" numeral 23 incorporates the bottom strip 23*a* and the top strip 23*b* for sliding engagement with the respective slots 37*a* and/or 37*b*, as well as with slots 39*a* and/or 39*b* depending upon whether characters are located upon both or one side of the backplate 12. The strip 23*a* of numeral 23 illustrates that its shape is in the form of a wedge wherein one face 40 is beveled with respect to the straight face 41; and, the bottom face 42 is also square with respect to the straight face 41. The wedge-shaped cross sectional configuration of the top and bottom strips 23*a*, 23*b* are adapted to snugly fit within the various slots 37*a*, 37*b*, 39*a* and 39*b* which are also wedge-shaped. The "7" numeral 23 also typically illustrates the lip 43 for resting and sliding upon the top portion of, for example, the extension 35*a* (see FIG. 2); and, the upper strip 23*b* which is the mirror image of the strip 23*a* incorporates a lip 43*a* which rests upon, for example, the top of extension 38*a*.

After the individual numerals comprising the address combination in "1100" are placed in position upon the backplate 12, they are kept in a tight juxtaposed position with one another. This is accomplished by respectively positioning spring members 21*a*, 21*b* on either end of the "1100" numeral combination such that the member 21*b* is positioned contiguously to the "0" numeral 22*a*, and the member 21*a* is located in the same manner to the "1" numeral 22. The member 21*a* (see FIG. 1), for example, extend between the lower and upper slots 37*a*, 39*a* and are made of a spring-like wire which restores itself to its original shape after being slightly deformed to allow insertion into the slots. The member 21*a* includes endings 11, 13 (see FIG. 1) which are designed to point oppositely from one another; hence, the ending 11*a* points or bites into the extension 35*a* whereas the ending 13 points or bites into the backplate 12 or vice versa depending upon how it is inserted. Spring member 21*b* illustrates how ending 11*a* points or bites into extension 35*a*. FIG. 2 further illustrates how the spring member 21*c* is inserted into the slots 37*b*, 39*b* on the reverse side of backplate 12 wherein its lower ending 21*d* points into the backplate 12, whereas, its upper ending 21*e* within slot 39*b* points into extension 38*b*.

The sign display 10 of the invention may be displayed in either one or three possible modes, namely, for hanging, standing in an up-right manner or positioning upon a wall surface. In order to permit the sign 10 to be displayed in the hanging mode, L-shaped hangers 20*a*, 20*b* are attached to the integrally formed male member 15 (see FIGS. 1, 2 and 5). Horizontal sections 14*a*, 14*b* of the respective Lshaped hangers 20*a*, 20*b* include female receptacles 15*a*, 15*b* for coupling with the male shaped member 15 integrally formed with backplate 12 which is graphically shown in cross section in FIG. 2. This male-female coupling is designed for a relatively tight fit so that separation cannot easily occur especially when outside conditions are windy. The L-shaped hangers 20*a*, 20*b* also respectively provide vertical sections 14*c*, 14*d* which include holed tabs 25*a*, 25*b* for receiving hooks (not shown) upon which to hang the sign 10. Slots 14*e*, 14*f* are also provided in the hangers 20*a*, 20*b* for receiving a rectangular plate 50 which may have the etched name of an owner or occupant and this arrangement is provided for those residents who desire a name identification in addition to an address. The positioning of the plate 50 within the slot 14*f* may be seen and appreciate by referring to FIGS. 1, 3 and 5. As understood, the Lshaped hangers 20*a*, 20*b* may be attached to a horizontal member (not shown) by means of nails or screws extending from a vertical post.

In the second mode of display the sign 10 may be positioned in an upright position upon, for example, a curb-side mailbox (not shown) or similar structure. This is accomplished by means of a longitudinal stanchion 18 (see FIGS. 1, 2) which may be independently attached to the mailbox by means of sheet metal or wooden screws (not shown) depending upon material of the box. Several holes such as hole 18*a* are provided for attachment purposes. After the stanchion 18 is attached to the mailbox or like structure it is ready to receive the backplate 12 via the male member 19*a*. The stanchion 18 and backplate 12 are joined to one another by coupling the male member 19*a* with the female receptacle 19. The coupling between the male member 19*a* and the female receptacle 19 is with a tight or press fit so that the backplate 12 is maintained in a firm and upright position during all types of weather conditions.

The third mode of display which may be optionally employed by the invention is by means of simple attachment of the backplate 12 to a flat surface of a residential or commercial entity. This is achieved by usage of holes, for example 12*a*, provided in the backplate 12 which allow entrance of simple wood or sheet metal screws (not shown) depending upon the surface upon which attachment is to take place.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. A sign comprising:

(a) a rectangular backing plate member having an integrally formed female cross section along its longest bottom dimension and a male cross section along its longest top dimension, and said bottom and top dimensions further including respective upward and downward facing extensions for combining with said member to form a respective lower and upper slot;

(b) a set of reflective numerals and/or alpha characters for positioning upon said backing plate member wherein each character includes a horizontal strip positioned across a top and bottom portion for slidable engagement and positioning within said upper and lower slots, and said numerals become semi-permanently attached to said backing plate member;

(c) first and second retention members for locating within said lower and upper slots and respectively positioned on the left and right side extremeties of a plurality of said characters which are to be maintained in juxtaposition with respect to one another;

(d) a longitudinal member having a male extension for coupling with said female cross section along said longest bottom dimension of said backing plate member for maintaining said sign in an upright position;

(e) a plurality of openings formed within said longitudinal member to form passageways for receiving attaching means to firmly maintain said sign in said upright position; and alternatively, (f) L-shaped members having female receptacles located along their respective horizontal sections for coupling with said male cross section positioned along said longest top dimension of said backing plate member, whereby one said L-shaped member being positioned at either end of said top dimension; and (g) an opening being formed in each vertical section of each L-shaped member in order to maintain said sign in a hanging position.

2. The sign in accordance with claim 1 and further comprising:

a slot formed in each said L-shaped member for receiving a rectangular plate upon which information may be placed.

3. The sign in accordance with claim 1 wherein each said first and second retention members including oppositely facing endings for respectively pointing in the direction of said extension and said backing plate member.

4. The sign in accordance with claim 1 wherein said horizontal strips of said characters include a lip for riding upon said upward and downward facing extensions when positioned in said slots.

5. The sign in accordance with claim 1 wherein said backing plate member includes openings for attachment to a flat surface.

6. The sign in accordance with claim 1 wherein said horizontal strips are wedge-shaped.

7. The sign in accordance with claim 6 wherein said upper and lower slots are wedge-shaped and adapted to slidably engage said wedge-shaped horizontal strips.

* * * * *